United States Patent [19]

Flatte

[11] 4,343,290

[45] Aug. 10, 1982

[54] HOT AIR FURNACE

[76] Inventor: James W. Flatte, 673 Bradford St. SW., Gainesville, Ga. 30501

[21] Appl. No.: 238,507

[22] Filed: Feb. 26, 1981

[51] Int. Cl.[3] ..... F24H 3/02

[52] U.S. Cl. ..... 126/110 E; 126/112; 126/117; 126/193; 237/55

[58] Field of Search ..... 126/110 R, 110 E, 110 AA, 126/99 R, 99 A, 99 D, 99 C, 117, 112, 106, 193, 108, 192, 109, 197; 165/DIG. 2; 237/55

[56] References Cited

U.S. PATENT DOCUMENTS

| | | | |
|---|---|---|---|
| 2,284,674 | 6/1942 | Murdock | 126/117 |
| 2,466,868 | 4/1949 | Scott | 126/117 |
| 4,044,820 | 8/1977 | Nobles | 237/55 |
| 4,083,398 | 4/1978 | Fallon | 126/117 |
| 4,201,187 | 5/1980 | Skow | 126/110 E |
| 4,202,318 | 5/1980 | De Podesta | 126/110 R |
| 4,232,651 | 11/1980 | Lind | 126/110 E |
| 4,241,874 | 12/1980 | Schossow | 237/55 |
| 4,275,705 | 6/1981 | Schaus et al. | 126/117 |
| 4,291,669 | 9/1981 | Herne | 126/112 |
| 4,292,950 | 10/1981 | Schossow | 126/112 |

*Primary Examiner*—Daniel J. O'Connor

*Attorney, Agent, or Firm*—Sughrue, Mion, Zinn, Macpeak & Seas

[57] ABSTRACT

A hot air furnace has an outer housing and a firebox positioned within the housing. A space between the outer housing and the firebox defines a pre-heating chamber which communicates through an air distribution blower to a lower chamber and an upper chamber within the housing. The walls of the firebox are hollow and open into the lower chamber and the upper chamber so that air extracted by the distribution blower from the pre-heating chamber and directed into the lower chamber is heated as it is channeled up through the hollow walls of the firebox prior to entering the upper chamber. A smoke chamber is located within the upper chamber and it serves to further heat the air entering the upper chamber. A combustion air blower is provided and it together with the distribution blower is automatically controlled by a thermostat located within the space to be heated. An anti-puffing device on the furnace loading chute is operated in conjunction with the chute door latching mechanism to permit air to enter the firebox prior to the door being opened thus preventing flames from leaping out of the furnace and injuring a person attempting to load the furnace.

10 Claims, 13 Drawing Figures

34
20
36
117
32
24
64
66
72
20
70
74
60
82'
82'
22
62
40
42
54
106
52
68
100
30
44
50
102
46
57
103
28
48
55
HOT AIR 5
5
7
64
6
6
60
20
62
82'
82'
74
68
54
44
106
102
52
50
103
46
100
57
48
30
55
47
56
150
7

HOT AIR FURNACE

BACKGROUND OF THE INVENTION

1. Field of the Invention

This invention pertains to a solid fuel burning furnace for heating air which is used to heat buildings, rooms, stock enclosures and chicken brooders.

2. State of the Prior Art

The prior art shows furnaces for heating homes and other buildings and they incorporate outer shells, fire boxes within the outer shells and blowers for forcing air between the spaces between outer shells and the firebox whereby the air is heated and is channeled into spaces to be heated. Unlike the present invention, the prior art does not show a furnace having thermostatically controlled distribution and combustion blowers, preheating chamber, smoke chamber, anti-puffing means and a firebox constructed of hollow tubes all of which function to provide a furnace which is efficient and safe to operate and inexpensive to manufacture.

Representative of the prior art are shown in the below listed patents.

| Patentee | Patent No. | Issue Date |
|---|---|---|
| J. L. Heiman | 3,171,400 | March 2, 1965 |
| W. L. Daniel | 4,047,515 | Sept. 13, 1977 |
| Webb | 4,030,479 | June 21, 1977 |
| Knight | 4,121,560 | Oct. 24, 1978 |
| Wright | 4,141,335 | Feb. 27, 1979 |
| Cagle | 4,149,671 | Apr. 17, 1979 |
| Maier et al | 4,180,051 | Dec. 25, 1979 |
| Black | 4,201,185 | May 6, 1980 |
| Niemela | 4,206,743 | June 10, 1980 |
| Scholtes et al | 4,206,804 | June 10, 1980 |
| Kerch | 4,215,669 | Aug. 5, 1980 |

SUMMARY OF THE INVENTION

This invention relates to furnaces for generating hot air to be used to heat homes, buildings, and farm structures such as chicken brooders.

One object of this invention is to provide a hot air furnace which has a distribution air blower and a combustion air blower, both thermostatically controlled, whereby the furnace is operated at optimum temperatures as required for a specific area to be heated.

Another object of this invention is to provide a hot air furnace having a preheating chamber which is adapted to heat ambient air by extracting heat from the firebox walls prior to entering the main heating chambers of the furnace.

It is still another object of this invention to provide a hot air furnace with a distribution blower adapted to withdraw the preheated air from the preheating chamber, mix the preheated air with ambient air prior to directing the mixture into the main heating chambers.

It is yet a further object of this invention to provide a hot air furnace with a firebox, three sides of which are constructed by welding together a plurality of hollow tubing. The tubings are open at their top and bottom ends, the top ends of which extend into a chamber which opens into the plenum of the furnace and the bottom ends of which extend below the floor of the firebox whereby air introduced under pressure from the distribution blower flows vertically through the hollow tubing and is heating before entering the plenum.

A further object of this invention is to provide a hot air furnace with a smoke chamber extending about the top of the firebox whereby heated air flowing vertically through the hollow tubes of the firebox is further heated before entering the plenum.

These and other objects of this invention will become apparent from a reading of the specification when considered in light of the annexed drawings.

DESCRIPTION OF THE PREFERRED EMBODIMENT

Figure 1:
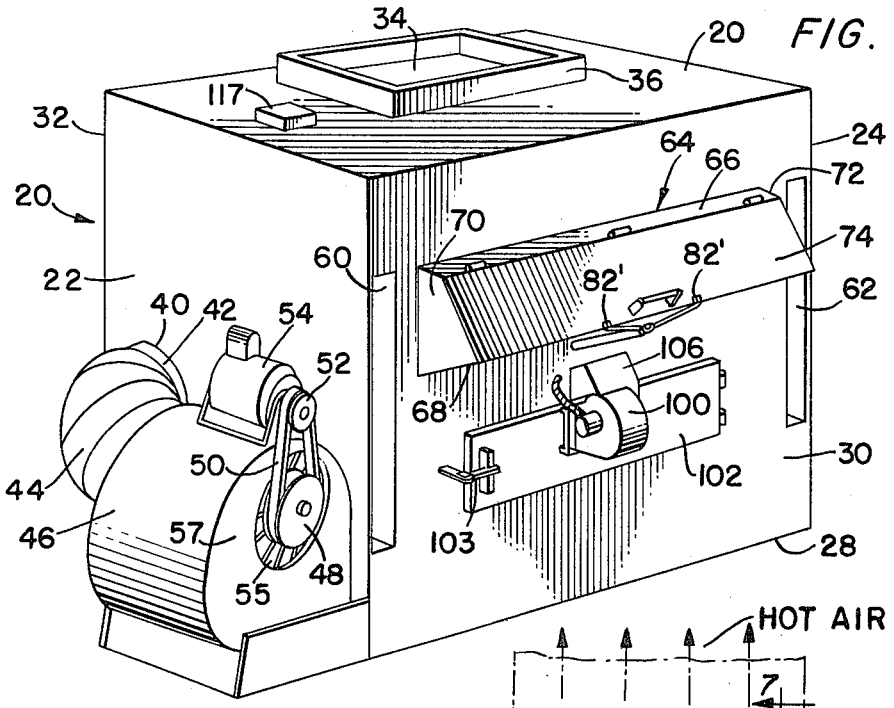
FIG. 1 is a perspective view of the furnace showing the distribution blower, the firebox blower, the front loading chute and the plenum opening.
Figure 2:
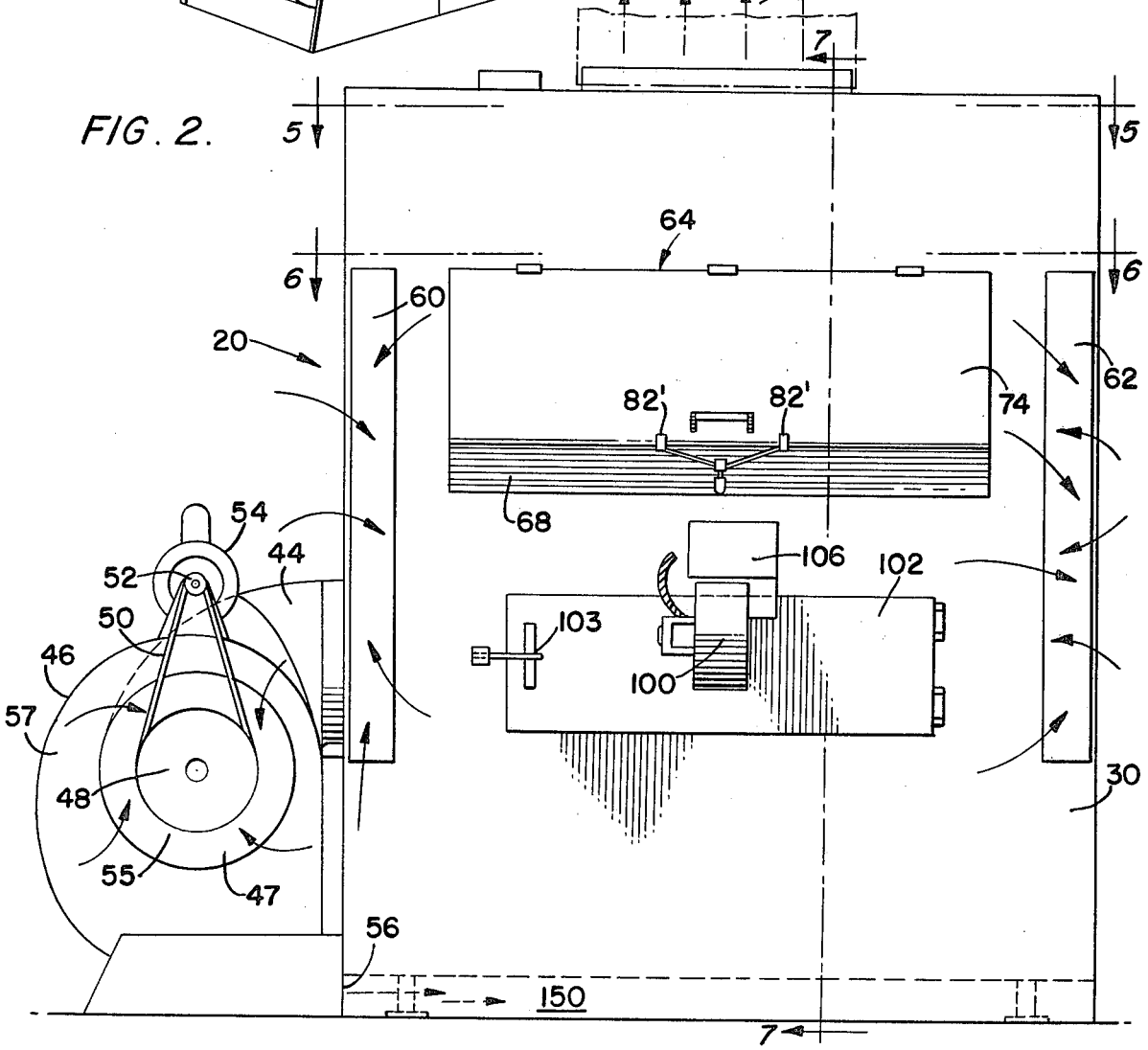
FIG. 2 is a front view of the furnace showing an air distribution blower at the side thereof, combustion air blower, air input openings and arrows showing movement of air into and out of the furnace.

Referring to the drawings in more detail, FIGS. 1 and 2 show a hot air furnace which is generally designated by the reference numeral 20. The furnace 20 has side walls 22 and 24, top and bottom walls 26 and 28 and front and rear walls 30 and 32. The top wall 26 has an opening 34 and a flange 36 surrounds the opening. The flange 36 is adapted to receive and support the end of ducting (not shown) which serves to convey hot air from the furnace into the space to be heated.

The side wall 22 has an opening 40 into which extends one end 42 of a flexible duct 44. The opposite end of the flexible duct is attached to the intake of an air distributor blower 46. The blower 46 may be in the form of a squirrel cage type device having a drive wheel 48 connected by a belt 50 to the driven shaft 52 of a motor 54. An opening 55 in the wall 57 of the blower 46 permits air to enter the fan during operation. The output end 56 of the blower extends through an opening in the wall 22 near the bottom thereof into the interior of the furnace and below the firebox, the latter to be later described.

Figure 9:
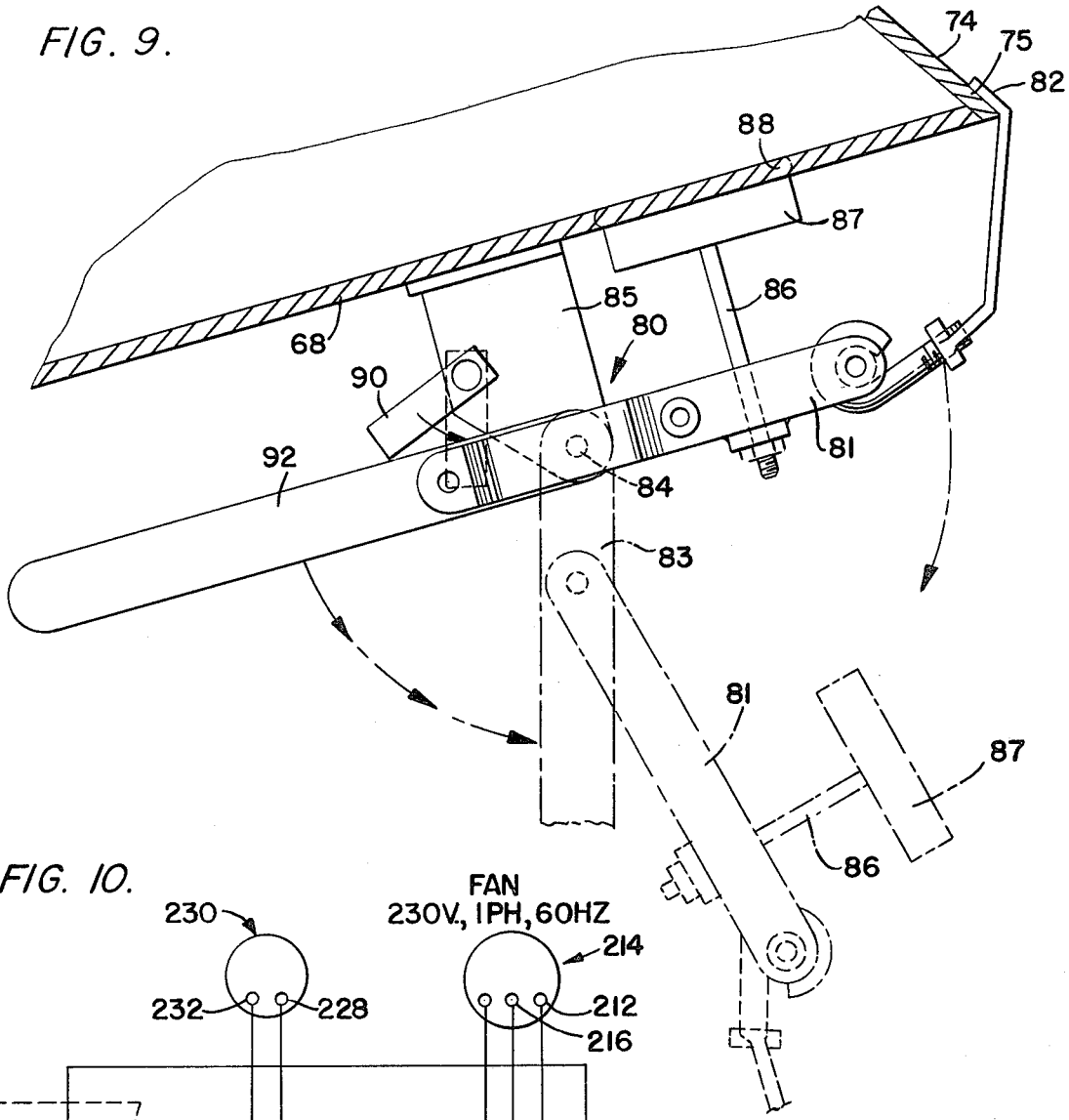
FIG. 9 is an end view of the loading chute door latching mechanism and an anti-puffing device operated in conjunction therewith.

The front wall 30 of the furnace has openings 60 and 62 through which air enters into the interior of the furnace. A loading chute 64 has top and bottom walls 66 and 68, side walls 70 and 72 and a door 74 hingedly attached to the top wall 66. The side walls 70 and 72 are slanted so that the door 74 rests thereagainst and slants downwardly and forwardly of the top wall 66. The door 74 lies flat against the edges of the slanted walls so as to be airtight when the door latching mechanism is in place. The door latching mechanism 80, FIG. 9, comprises an arm 81 having door engaging hooks 82 (one shown) at one end thereof. The opposite end of arm 81 is attached to a toggle linkage 83, the latter being pivotally attached at 84 to the bottom wall 68 of the loading chute by a bracket 85. A rod 86 is attached to the arm 81 by any suitable means. The rod has a disc-like end 87 which is adapted to cover a hole 88 cut through the wall 68 when the latching mechanism is in operative position. In this regard, when the latching mechanism is in operative position as shown by the solid lines in FIG. 9, the hook 82 engages the end 75 of door 74 thus holding the door tightly and sealingly against the edges of the chute walls. Further, in order to provide a tight seal, sealing rope in the nature of asbestos is positioned about the edges of the chute so that the door abuts thereagainst when it is in closed position. A micro switch activator is attached to arm 90 which is pivotally attached to the bracket 85 and is engaged and raised by the lever arm 92 when the latching mechanism is in operative position. The micro switch is connected by suitable conductors to a combustion blower 100. The combustion blower 100, as well as being thermostatically controlled, is operated by the micro switch when the latching mechanism handle 92 is raised one eighth of an inch prior to removal of the hook 82 from the door. In this connection, the micro switch lever falls by gravity to the dotted line position as shown in FIG. 9 and this functions to operate the micro switch which in turn turns on the combustion blower 100 thus adding air under pressure to the combustion chamber. In addition, when the latching mechanism is moved to its inoperative position, that is to say to a position where the door may be opened, the disc 87 is withdrawn away from the opening 88 and air enters the combustion chamber just below the door opening. This is a safety feature of the invention in that should the loading door be opened while the furnace is in operation, flames may rush out of the door opening possibly causing injury to the person loading the furnace. The out rush of flames is prevented by air rushing into the furnace firebox through the opening 88 which has been uncovered by moving the latching mechanism into inoperative position. The latching mechanism may utilize a pair of hook members 82 and 82' as shown in FIG. 1 to maintain the door tightly shut.

Figure 8:
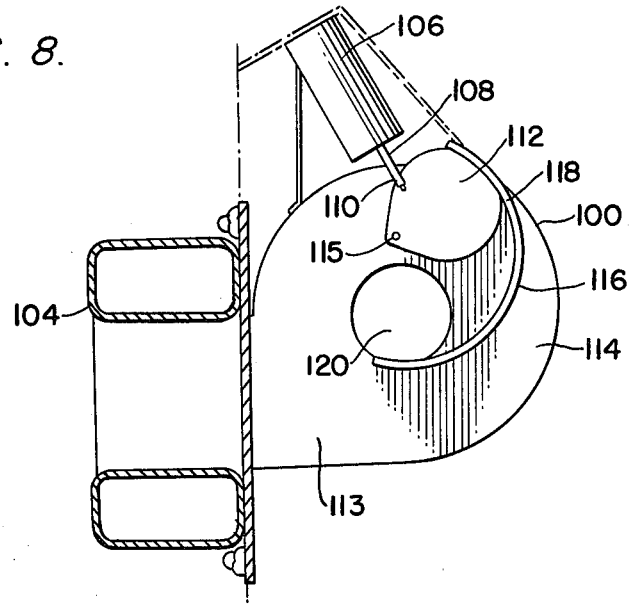
FIG. 8 is a side view of the combustion blower for introducing air into the combustion chamber and shows a valve which is operated by a solenoid which is thermostatically controlled to permit air to be pulled by the blower for subsequent introduction into the firebox.

The combustion air distributor blower 100, FIG. 8, is attached to a door 102 which is hingedly attached to the front wall 30 of the furnace. Door 102 closes an opening into the firebox whereby ash may be removed. A latching mechanism 103 of any conventional design is utilized to close the door in a sealed condition. The combustion air distributor blower 100 is attached to the door 102 and its input end 104 extends through an opening in the door and into the firebox. A solenoid 106 is attached to the combustion air blower 100. The solenoid 106, FIG. 8, has a plunger 108 extending from within the solenoid and has its outer ends 110 attached to a pivotable cover 112. The cover 112 is pivoted to a side wall 113 of the blower 100 by any suitable connection 115. A spring 116 is attached to the periphery 118 of the cover at one end and at the opposite end to the side wall 113 immediately below an opening 120. The spring 116 operates to maintain the flap 112 over the hole 120. Air input to the fire is controlled by the solenoid. In this regard, the solenoid is activated by a limit switch which is placed in a housing 117 located on the top wall 26 and adjacent to the plenum opening 34. The temperature in the plenum controls the operation of the limit switch. In this regard, when the temperature within the plenum drops below a certain degree, the limit switch is operated to activate both the blower 100 and solenoid 106. The solenoid plunger 106 which retracts thus removing the cover 112 and allowing air to enter the combustion air distribution blower 100 which is subsequently directed into the firebox thus firing up the fire to heat the air flowing within the furnace.

The firebox 120, FIGS. 4–7 comprises a rear wall 122, side walls 124 and 126 and front wall 30 of the furnace. The front wall 30, rear wall 122, side walls 124 and 126, form the four sides of the firebox. The rear wall 122 and side walls 124 and 126 comprise a plurality of hollow tubes 130 which are welded together to form three surfaces of the firebox. The hollow tubes are opened at their tops 132 and bottoms 134. A floor 136 of the firebox extends across the inside walls of the hollow tubes near their bottom ends 140. The floor is also welded to the inside of the front wall 30. It will be noted that the bottom openings of the tubes extend below the floor of the firebox on three sides thereof. A plurality of firebrick 137 line the floor 136 and any suitable grate (not shown) may be supported on the firebrick to hold logs to be burned.

A roof 143 extends between the rear wall 122, side walls 124 and 126 and front wall 30 immediately below the upper openings 132 of the hollow tubes. In this regard, the openings of the upper ends of the hollow tubes extend into a chamber immediately below the plenum opening 34.

The outside surfaces 142 of the rear wall 122 and the side walls 124 and 126 form the inside walls of a preheating chamber 148 which extends around three sides of the furnace. The inside surfaces 150 of the side walls 22 and 24 and rear wall 32 form the other inside wall of the preheating chamber. The space between the surfaces 142 and 150 define a passageway about the interior of the furance where air is preheated by contacting the heated surfaces 142 of the tubular members. Air enters the preheating chamber through openings 60 and 62 in the front wall 30 of the furnace. The preheated air in space 148 is extracted by the distributor blower fan 46 and this air is combined with ambient air drawn in through opening 55 of the blower and the mixture is directed into an enclosure beneath the firebox. The area 150, FIG. 4, beneath the firebox is a chamber defined by the lower portions of the side walls 22, 24 and front wall 30 and rear wall 32. The output 56, FIG. 2, of the distributor blower 46 extends through an opening in the lower portion of side wall 22. This can be best seen in FIG. 2 and the air from the distributor blower circulates beneath the firebox in space 150. Thus, the preheated air in space 148 is extracted by the distributor blower 46 through the flexible duct 44 and is then mixed with ambient air entering through hole 55 and the mixture is then directed into the space 150 beneath the firebox. This air which is under pressure is directed vertically through the hollow tubes and is heated by the heat of the firebox.

Figure 4:
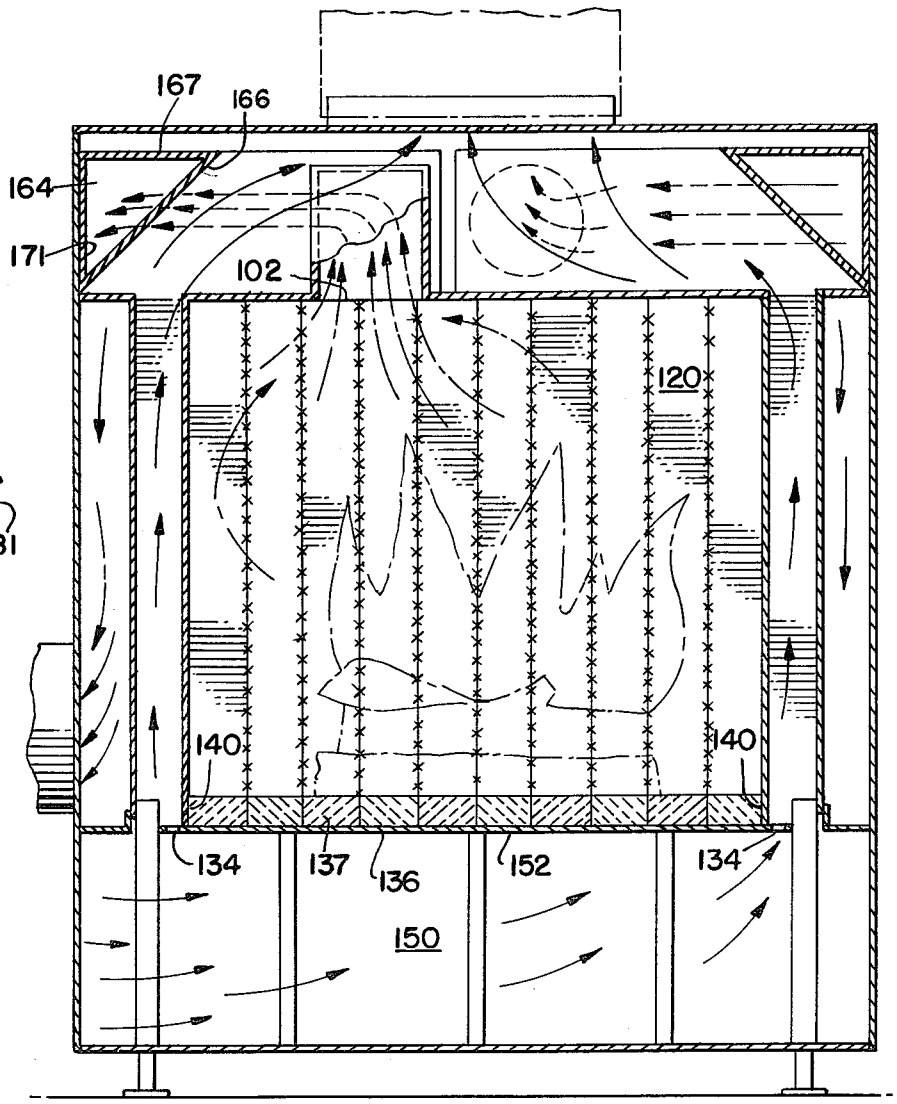
FIG. 4 is a broken away view of the interior of the furnace showing air flowing through a preheating chamber into the flexible duct, a triangular smoke chamber above the firebox, and the firebox walls constructed from hollow tubular members welded together.
Figure 3:
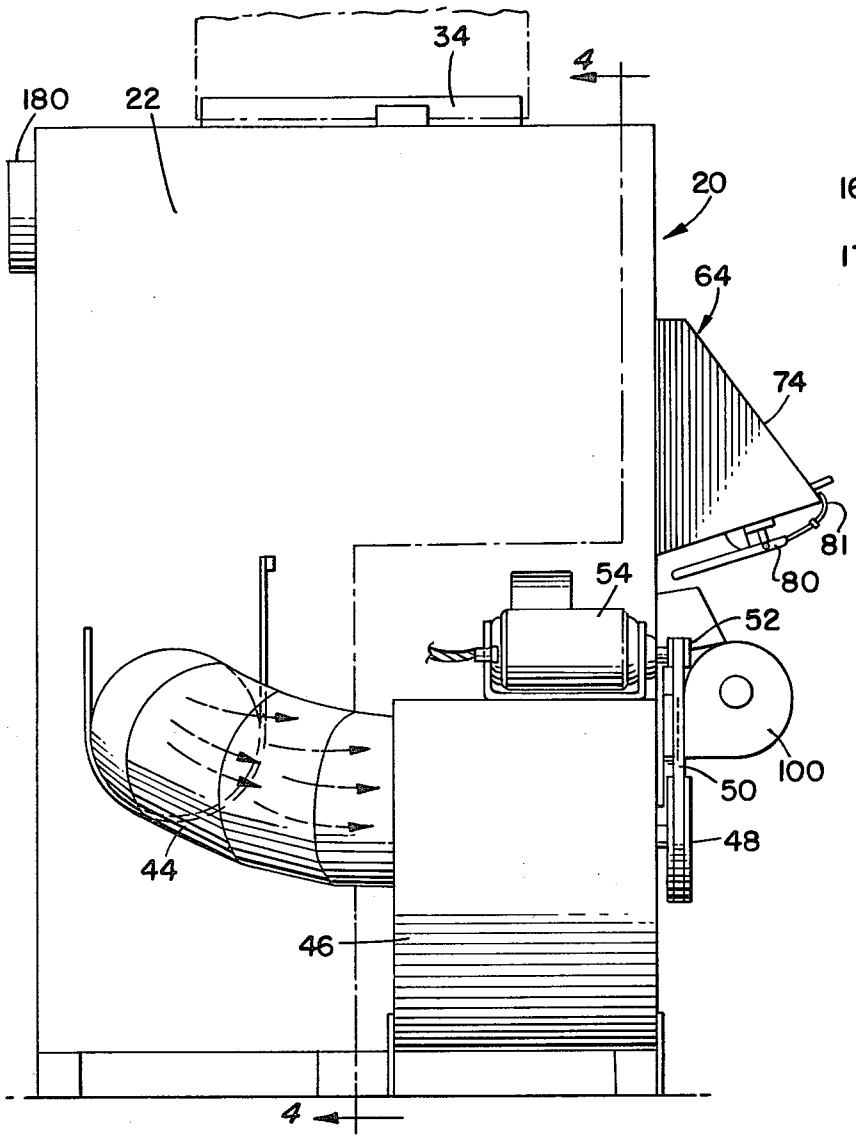
FIG. 3 is a side view of the furnace showing the air distribution blower, a flexible duct extending from within the furnace to the blower, a motor to operate the distribution blower, and a blower for introducing air into the combustion chamber.
Figure 5:
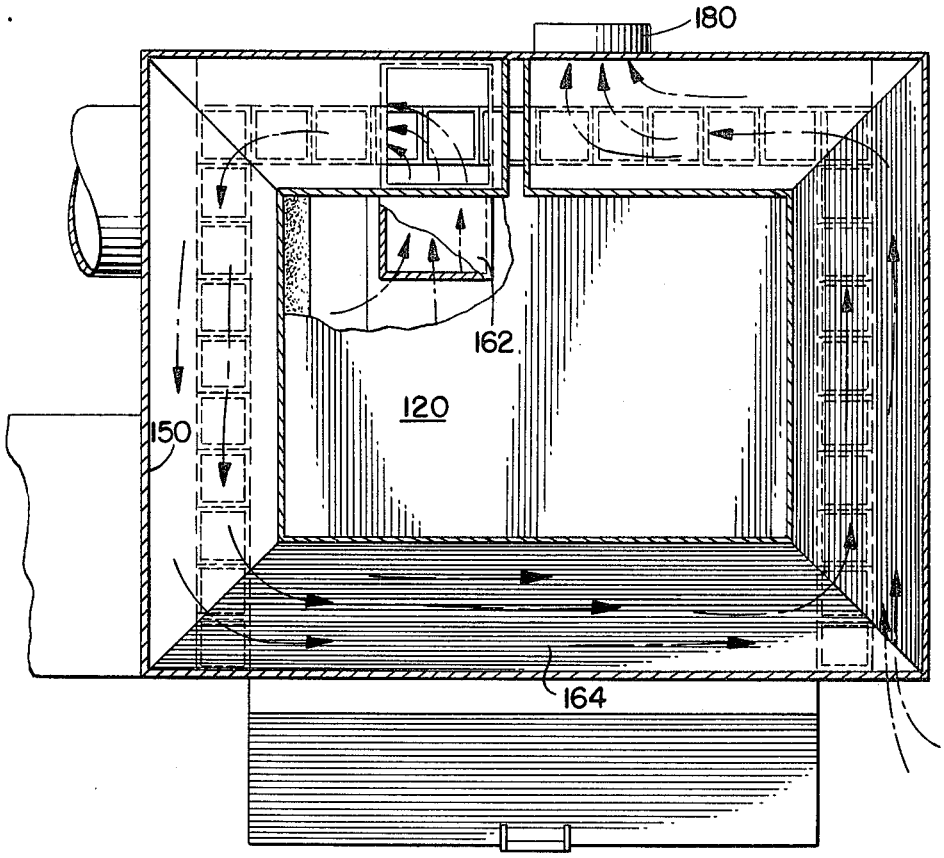
FIG. 5 is a plan view of the furnace taken along the line 5—5 of FIG. 2 looking into the interior thereof and showing smoke flowing into the smoke chamber and out the flue pipe.
Figure 6:
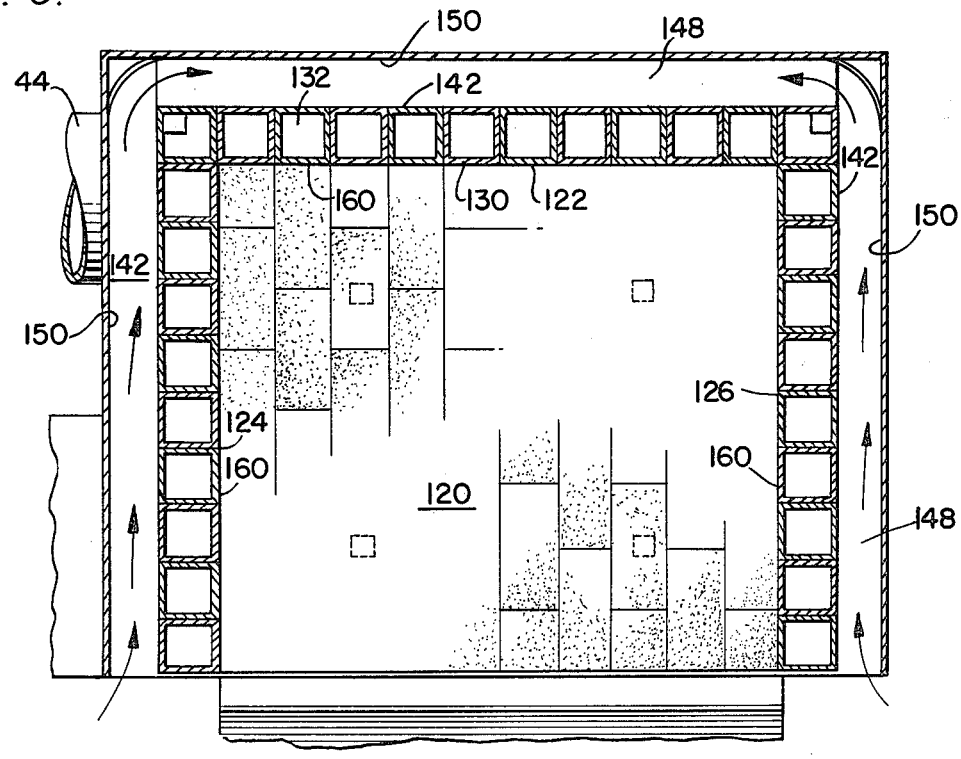
FIG. 6 is a plan view of the furnace taken along the line 6—6 of FIG. 2 and shows the preheating chamber, air flowing thereabout and the hollow tubes which define the firebox walls.
Figure 7:
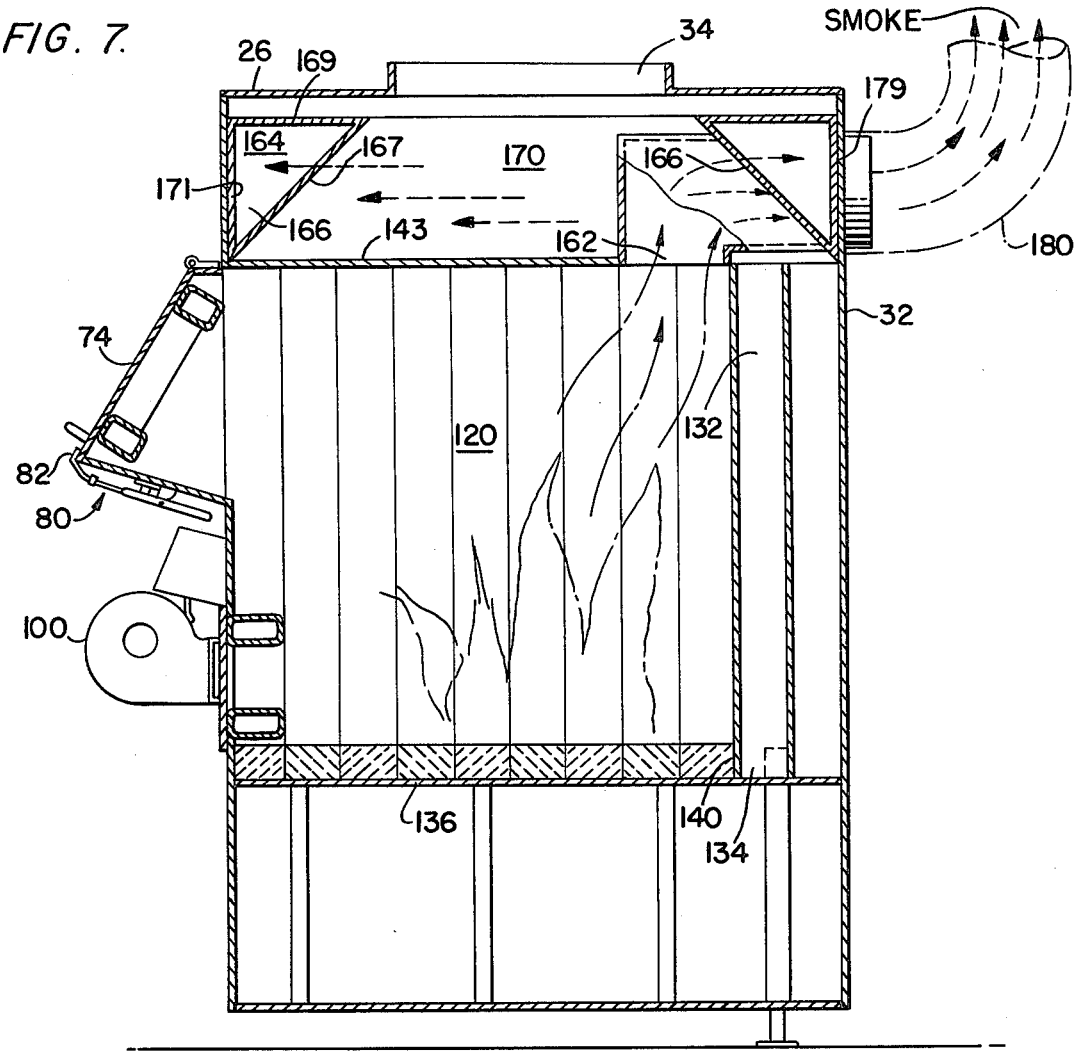
FIG. 7 is a side elevational view of the furnace through the firebox, and shows the smoke chamber above the firebox, the blower for introducing air into the fire chamber and a chamber above the firebox where heated air collects prior to entering the plenum.

The tops of the hollow tubes open into a chamber 170, FIG. 7, which is directly below the plenum and plenum opening 34. The floor 136 and the roof 143 prevent combustion gases from entering the space below the firebox and from entering the space below the plenum and plenum opening. Notwithstanding that the roof seals the top of the firebox and prevents combustion gases from entering the chamber 170, an opening 162 is cut in the roof and this permits the smoke of combustion to enter a smoke chamber 164 which surrounds the top of the firebox and is within the space 170. FIG. 4 and FIG. 7 shows the opening in the roof and the smoke chamber. The latter is a triangular chamber having a space 166 defined by slanting walls 167, horizontal walls 169 and the inside wall 171, FIG. 7. The triangular smoke chamber 164 extends around the periphery of the upper portion of the furnace and smoke exits from the smoke chamber through an opening 179 and then through a flue pipe 180 to the outside of the furnace. It is important to note that the smoke chamber is heated by the hot gases and smoke from the combustion chamber. The hot gases and smoke heat the slanted walls 167 and hot air entering the chamber 170 from the hollow tubes strikes the surfaces 167 and is further heated thereby prior to entering the plenum through hole 34.

As will be readily apparent, preheated air enters the space 150 below the firebox and is forced vertically through the hollow tubes 130 where it is heated by the heat from the combusiton chamber. The heated air enters into the space 170 striking the slanted walls 167 where it is further heated prior to entering the plenum and into the space to be heated. The hot smoke and gases from the smoke chamber exits through the hole 179 in the furnace and is conveyed by flue pipe 180 to the outside air. Switch boxes for the electrical switches may be attached to the outside walls of the furnace at any suitable locations. For example, a switch box for turning the distributor blower 46 on and off may be attached to the wall 22 adjacent to the blower. Similarly, the combustion air blower switch may be positioned on the side of the furnace at any accessable location.

Figure 10:
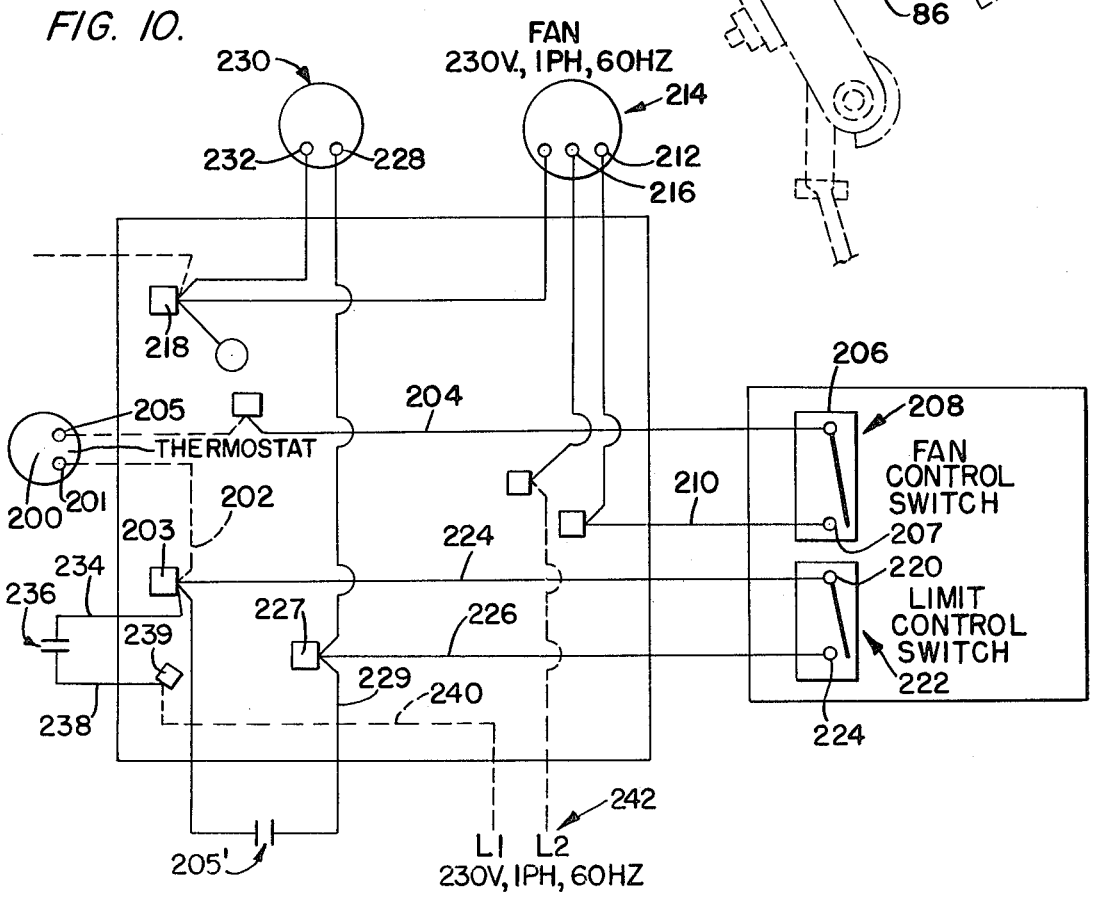
FIG. 10 is a schematic drawing of the electronic circuitry and the thermostat for controlling operation of the blowers.

The electrical circuitry for the furnace blowers, solenoid, micro switch and thermostat is shown in FIG. 10. The thermostat is shown at 200 and it is located within the space to be heated. One terminal 201 of the thermostat 200 is connected by a conductor 202 through a terminal post 203 to one side of a micro switch 205. The other terminal 205 of the thermostat is connected by a conductor 204 to one side 206 of the distributor blower control switch 208. The opposite side 207 of the switch is connected by a conductor 210 to an input terminal 212 of the distributor blower motor 214. Another input lead 216 is connected to the one terminal of an electrical outlet 242. The motor 214 is grounded at 218.

One end 220 of the combustion distributor blower limit switch 222 is connected by a conductor 224 through the terminal post 203 to terminal 201 of the thermostat 200. The opposite terminal 224 of the switch 222 is connected by a conductor 226 through a terminal post 227 to the input terminal 228 of the combustion distributor blower motor 230. A conductor 229 is connected from the terminal post 227 to the other side of the micro switch 205. The other terminal 232 of this motor is grounded at 218. A conductor 234 connects the terminal post 203 to one side of a master switch 236 and a conductor 238 connects terminal post 239 to the opposite side of the master switch. A conductor 240 connects the terminal post 239 to the other side of an electrical outlet 242. The micro switch 205 is opened by the arm 90 when it moves upon raising the lever arm 92, whereby the combustion blower 100 is turned on. The switches 208 and 222 are bi-metallic disc switches which are effected by the temperatures within the plenum. That is to say, the switches are placed adjacent to the plenum in housing 117 and are operated by the temperatures therein.

In operation, the limit control switch 222 for the combustion distributor blower is normally closed. Upon firing of the furnace, the limit switch 222 is closed and will remain closed thus providing air to the fire until the temperature within the plenum reaches 190 degrees plus or minus 5 degrees. When this predetermined temperature has been reached, the limit switch will cut off and the combustion distribution blower will stop. The thermostat within the area to be heated is normally in the closed (on) position and will be activated whenever the temperature within the space to be heated reaches a certain predetermined value. The distribution blower switch 208 is normally open and will remain open until the temperature within the plenum reaches 150 degrees plus or minus 5 degrees. When this temperature is reached the switch will close thus turning on the distribution blower 46. Preheated air is drawn from the preheating chamber and is conveyed through the distribution blower 46 into the space 150 beneath the firebox. This air under pressure is directed vertically through the hollow tubes 130 where it is heated and exits the upper open ends 132 of the tubes and flows into chamber 170 above the firebox. The heated air strikes the slanted surfaces 167 of the smoke chamber 164 and it is again heated before exiting through the opening 34 into the plenum where the heated air is then conveyed by ducting to the space to be heated.

When the thermostat detects the previously determined optimum temperature within the scope to be heated, it will cut off thus breaking the electrical connection to the distributor blower. However, if the temperature within the plenum drops to 110 degrees plus or minus 5 degrees as a result of the fire burning out, the distributor blower will cut off and will remain off until the temperature within the plenum again reaches the appropriate level. Once the temperature within the plenum drops below 140 degrees plus or minus 5 degrees, the combustion blower will turn on and supply more air to the combustion chamber to feed the fire therein.

When it is desired to add fuel such as logs to the fire, the latching mechanism 80 of the door 74 is activated by pulling outwardly on lever 92 which toggles the mechanism such that hooks 81 disengage from the door. Counterweights may be used so as to permit the door to be easily raised. Once the handle lever 92 is pulled outwardly, the micro switch lever 90 will drop and thus activating the switch which in turn activates the combustion distributor blower to add air to the fire. At the same time, the disc 87 which covers the opening 88 will have retracted away from the opening thus allowing air to enter the firebox just beneath the door. This operation prevents back-puffing, a term used to describe that condition when flames from the furnace leap out through the open door. By use of the micro switch to operate the combustion distribution blower and the disc 87 to uncover the opening 88, the furnace is made safe by preventing back-puffing and thus preventing injury to a person attempting to load the furnace.

Figure 11:
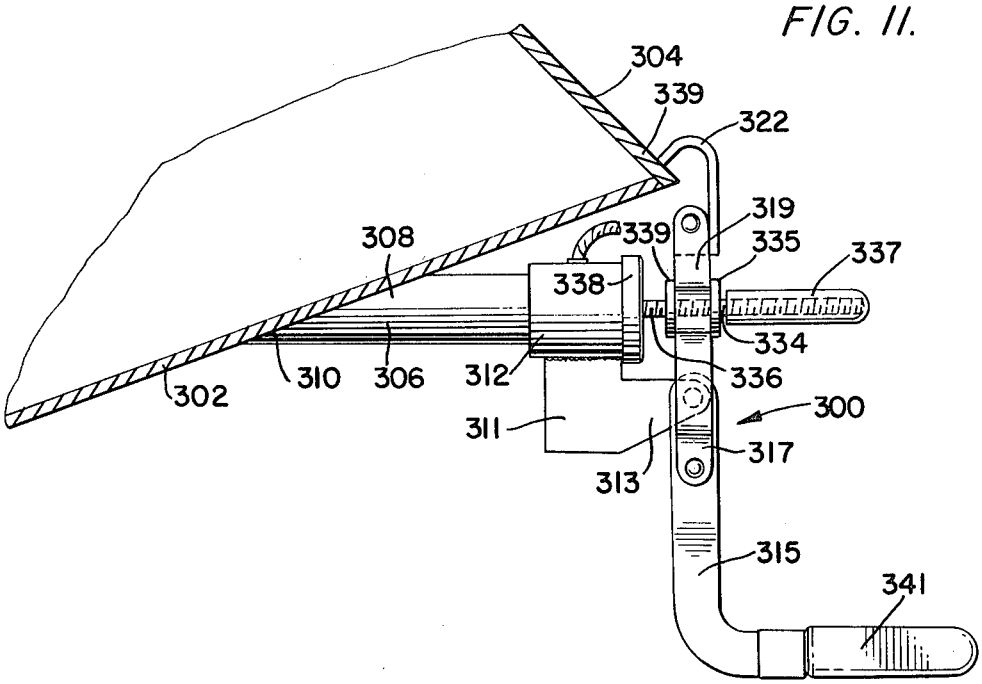
FIG. 11 is a side view of a modified form of the front chute door latching mechanism and an anti-puffing device operated in conjunction therewith.
Figure 12:
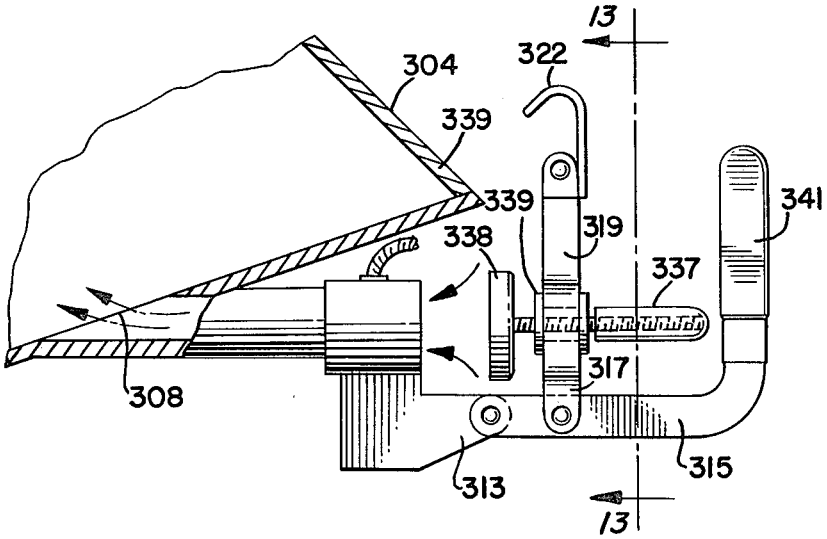
FIG. 12 is a side view of the device of FIG. 11 and shows the latching mechanism open to permit opening of the door for loading fuel.
Figure 13:
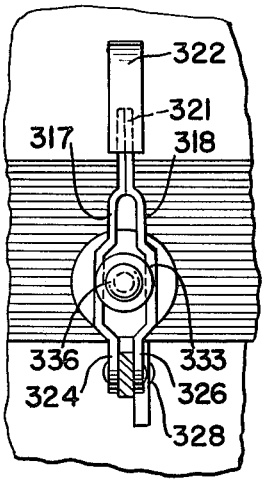
FIG. 13 is an end view taken along the line 13—13 of FIG. 12.

A modified form of the door latching mechanism and the anti-puffing device is shown in FIGS. 11, 12 and 13. The mechanism 300 is attached to a wall 302 of the loading chute just below the door 304. A hollow tube 306 is attached to the wall 302 and covers an opening 308 in the wall. A cylindrical housing 312 is attached to the opposite end of the tube 306 as by welding or the like. A bracket 311 is welded to the housing 312 and it is provided with a forwardly extending arm 313. A lever arm 315 is pivotally attached to the arm 313 and ends 317 of a second lever 319 is pivotally attached to the lever 315 a distance near to the lever connection to arm 313. The lever 315 is in the form of two parallel bars 317 and 318 joined at their ends 321 and to which a hook 322 is attached. The opposite ends 324 and 326 of the lever 319 are attached to lever 315 by a bolt and nut arrangement 328. The bars are separated to form guide elements 233 for rod 334. The rod 334 is threaded for reception of washers 335 and 339 which are adjustable along the rod 334 and are positioned between the guide elements 333. The guide elements 333, rod 334 and washers 335 and 339 serve to adjustably position the cap 238 relative to the member 312. The end 336 of the rod is attached to the cap 338 which is adapted to cover the open end of the cylindrical member 312. The opposite end 337 of the rod carries a wooden handle 337. The hook 322 bears against the end 339 of the door 304 when the lever handle 341 is in the position shown in FIG. 11. The cap 338 is forced tightly against the open end of the cylindrical housing 312 such that no air is permitted to enter through the tube 306 into the furnace. Upon raising the lever handle 341 vertically, a toggle action occurs by the connection of arm 315 to lever 317 such that the lever 319 moves rearwardly whereby the washer 335 bears against the edge 340 of handle 337 whereby the cap 338 moves away from the housing 312 thus allowing air to enter the firebox. Continued movement of handle 341 vertically causes the hook 322 to move away so that the door 304 may be opened. A micro switch may be positioned within the cylindrical housing 312 and operable upon removal of the cap 338 away from the opening of the housing. The micro switch would function to activate the combustion distribution blower to turn it on and allow air to be directed into the combustion chamber. By this construction, it will be apparent that upon operating the door latching mechanism antipuffing is achieved due to the air entering the cylindrical housing 312 and passing through tube 306 into the combustion chamber just beneath the door. Also, when the micro switch in cylindrical housing 312 is activated, the combustion distribution blower is turned on whereby air is directed into the furnace.

Although the invention has been described and explained in respect of the preferred embodiment of the invention, modificaions, variation and changes in detail are possible and such modifications, variations and changes would be considered within the scope of the present invention. It is intended that the description of the preferred embodiment of the invention and as shown in the drawings should be interpreted as illustrative and not as limiting in any sense.

What I claim is:

1. A hot air furnace comprising:

an outer housing having a smoke exit, a hot air exit to a space to be heated and a fuel loading chute having a closure thereon;

a firebox having side walls, a rear wall and a front wall;

a pre-heating chamber between the outer housing and the firebox;

a lower chamber beneath the firebox;

an upper hot air chamber above the firebox, said hot air chamber in communication with the hot air exit;

an air distribution blower for directing air between the pre-heating chamber and the lower and upper chambers;

heat exchange means between the lower and upper chambers, said heat exchange means adapted to permit air to pass between said chambers;

a smoke chamber above the firebox, said smoke chamber in communication with the firebox and the smoke exit, and in heat exchange communication with the hot air chamber;

a combustion blower for feeding air to the firebox;

means within the space to be heated connected to the blowers for automatically operating the blowers whereby the fire is fed by the combustion blower and the space to be heated is supplied with hot air by the distribution blower which extracts preheated air from the pre-heating chamber and forces said air into the lower chamber and through the heat exchange means into the upper chamber where the hot air is further heated upon contact with the smoke chamber prior to exiting the hot air exit into the space to be heated; and latching means to the loading chute closure.

2. A hot air furnace as defined in claim 1, wherein:

said firebox comprises hollow side walls and a hollow rear wall.

3. A hot air furnace as defined in claim 2, wherein:

said hollow side walls and said hollow rear wall are comprised of a plurality of tubular members secured together.

4. A hot air furnace as defined in claim 1, wherein:

said pre-heating chamber is in heat exchange communication with said side walls and said rear wall of the firebox.

5. A hot air furnace as defined in claim 1, wherein:

said heat exchange means adapted to permit air to pass between the lower chamber and the upper chamber comprises a plurality of hollow tubular members secured together to form separate passages through which the air passes between said chambers.

6. A hot air furnace as defined in claim 1 wherein:

said smoke chamber is a triangular housing which circumscribes the upper chamber above the firebox.

7. A hot air furnace as defined in claim 6, wherein: said firebox has a roof having an opening therein for permitting smoke from the firebox to enter the smoke chamber whereby the walls of the smoke chamber are heated by the hot smoke circulating within the smoke chamber.

8. A hot air furnace as defined in claim 6, wherein: said smoke chamber has a plurality of walls one of which slants upwardly and inwardly and is so positioned within the upper chamber that hot air entering the upper chamber through the heat exchange means strikes the slanted surface whereby it is further heated before exiting the hot air exit and into the space to be heated.

9. A hot air furnace as defined in claim 1, wherein: said loading chute has means thereon for permitting air to enter the firebox upon unlatching of the chute closure latching means, whereby flames within the firebox are prevented from escaping out through the chute opening when the closure is removed thus preventing injury to a person attempting to load the firebox with fuel and a micro switch operated upon unlatching of the chute closure latching means whereby the combustion blower is turned on.

10. A hot air furnace as defined in claim 9, wherein: said means for permitting air to enter the firebox comprises a hollow tubular member secured at one end within an opening in one of the walls of the loading chute and having a removable closure at the opposite end thereof, said removal closure operable in conjunction with the door latching mechanism whereby when the door latching mechanism is operated to permit opening of the door, the closure of the tubular member is opened to permit air to rush into the firebox prior to the door being opened thus preventing fire from escaping through the door opening and injuring the person attempting to load the firebox with fuel.

* * * * *